US008563905B2

(12) United States Patent
Boer et al.

(10) Patent No.: US 8,563,905 B2
(45) Date of Patent: Oct. 22, 2013

(54) METHOD FOR CONTROLLING THE INDUCTION HEATING SYSTEM OF A COOKING APPLIANCE

(75) Inventors: Alessandro Boer, Biandronno (IT); Francesco Del Bello, Rome (IT); Diego Neftali Gutierrez, Varese (IT); Jurij Paderno, Varedo (IT); Davide Parachini, Cassano Magnago (IT); Gianpiero Santacatterina, Sangiano (IT)

(73) Assignee: Whirlpool Corporation, Bentor Harbor, MI (US)

( * ) Notice: Subject to any disclaimer, the term of this patent is extended or adjusted under 35 U.S.C. 154(b) by 531 days.

(21) Appl. No.: 12/628,493

(22) Filed: Dec. 1, 2009

(65) Prior Publication Data

US 2010/0138075 A1 Jun. 3, 2010

(30) Foreign Application Priority Data

Dec. 2, 2008 (EP) ..... 08170518

(51) Int. Cl.
*H05B 6/12* (2006.01)

(52) U.S. Cl.
USPC ..... 219/620; 219/660

(58) Field of Classification Search
USPC ..... 219/660, 663, 620; 700/300
See application file for complete search history.

(56) References Cited

U.S. PATENT DOCUMENTS 4,356,371 A 10/1982 Kiuchi et al.
4,900,884 A * 2/1990 Aoki ..... 219/601
6,078,034 A * 6/2000 Le Van Suu ..... 219/705
6,118,105 A * 9/2000 Berkcan et al. ..... 219/497
6,140,617 A * 10/2000 Berkcan et al. ..... 219/446.1
6,372,059 B1 4/2002 Yasuda et al.
6,381,518 B1 * 4/2002 Huffington et al. ..... 700/299
6,462,316 B1 * 10/2002 Berkcan et al. ..... 219/502
6,864,465 B2 * 3/2005 Berkcan et al. ..... 219/448.11
8,283,605 B2 * 10/2012 Arione et al. ..... 219/413
2003/0095034 A1 * 5/2003 Clothier ..... 340/10.1
2004/0099652 A1 * 5/2004 Berkcan et al. ..... 219/448.11
2005/0251373 A1 * 11/2005 Daems et al. ..... 703/2
2006/0224534 A1 * 10/2006 Hartman et al. ..... 706/15
2008/0087661 A1 * 4/2008 Haag et al. ..... 219/620
2008/0110875 A1 * 5/2008 Fisher ..... 219/483
2008/0121633 A1 * 5/2008 Pinilla et al. ..... 219/494

FOREIGN PATENT DOCUMENTS

EP 0427879 5/1991
EP 1420613 A2 5/2004
EP 1732357 A2 12/2006
EP 1898063 3/2008

* cited by examiner

*Primary Examiner* — Caridad Everhart
(74) *Attorney, Agent, or Firm* — Diederiks & Whitelaw PLC

(57) ABSTRACT

A method for controlling an inductive heating system of a cooking hob provided with an induction coil is disclosed. The method controls it in connection with a predetermined working condition, comprises assessing the value of power absorbed by the system, measuring a temperature indicative of the thermal status of at least one element of the heating system, feeding the assessed power value to a computing model capable of providing an estimated value of temperature, comparing the measured temperature with the estimated temperature and tuning the computing model on the basis of such comparison.

20 Claims, 5 Drawing Sheets

METHOD FOR CONTROLLING THE INDUCTION HEATING SYSTEM OF A COOKING APPLIANCE

BACKGROUND OF THE INVENTION

1. Field of the Invention

The present invention relates to a method for controlling an induction heating system of a cooktop provided with an induction coil, particularly for controlling it in connection with a predetermined working condition.

More specifically the invention relates to a method to estimate the temperature of a cooking utensil placed on the cooktop and the temperature of the food contained therein, as well as the food mass.

2. Description of the Related Art

With the term "heating system" we mean not only the induction coil, the driving circuit thereof and the glass ceramic plate or the like on which the cooking utensil is placed, but also the cooking utensil itself, the food content thereof and any element of the system. As a matter of fact in the induction heating systems it is almost impossible to make a distinction between the heating element, on one side, and the cooking utensil, on the other side, since the cooking utensil itself is an active part of the heating process.

The increasing need of cooktops performance in food preparation is reflected in the way technology is changing in order to meet customer's requirements.

Technical solutions related to the evaluation of the cooking utensil or "pot" temperature derivative are known from EP-A-1732357 and EP-A-1420613, but none discloses a quantitative estimation of the pot temperature Information are available in scientific literature about algorithms concerning state estimation (Recursive Least Square, Kalman Filter, Extended Kalman Filter [EKF], etc.); none of them relates to an industrial application focused on induction cooking appliances.

SUMMARY OF THE INVENTION

It is an object of the present invention to provide a method according to which the temperature of the pot and/or of the food contained therein can be assessed in a reliable way, particularly with reference to a heating condition in which the temperature has to be kept substantially constant (boiling condition or the like).

The control method according to the present invention is used for estimating the temperature of a pot, pan or griddle (in the following indicated simply as "pot"), used onto the induction cooktop, food thermodynamics state inside the pot (mass and temperature/enthalpy/entropy/internal energy/etc.) and induction coil temperature by the knowledge of an estimation of the power absorbed by the device and at least one temperature information (glass, coil, pot, etc.)

It is worth pointing out that the estimated power can be measured, assumed equal to a predetermined reference, or estimated by one ore more electrical measurements.

In general, the estimation reliability (roughly such reliability could be assumed a function of the difference between the actual value and the estimated value) gets better and better as the number of measured temperatures increases.

The estimated pot temperature can be used e.g. to monitor or control said temperature; the estimated food temperature can be used e.g. to monitor or control the temperature or the cooking phase (as boil detection, boil control, particularly in case the food is water or a similar liquid). The estimated food mass could be used e.g. to monitor or control the cooking phase. The estimated coil temperature could be used e.g. to prevent damages.

Another aspect of the method according to the invention is to compensate different noise factors affecting the evaluation of the pot temperature or of the food contained therein, and of its mass as well. Some noise factors that can affect such estimation are for example the initial pot/food temperature and initial food mass, the voltage fluctuation of the electrical grid, the tolerances/drift of the components, the use of different pots and the possible movements of the pot from its original position.

BRIEF DESCRIPTION OF THE DRAWINGS

Further features and advantages according to the present invention will become clear from the following detailed description with reference to the annexed drawings in which.

DETAILED DESCRIPTION OF THE PREFERRED EMBODIMENTS

Figure 2:
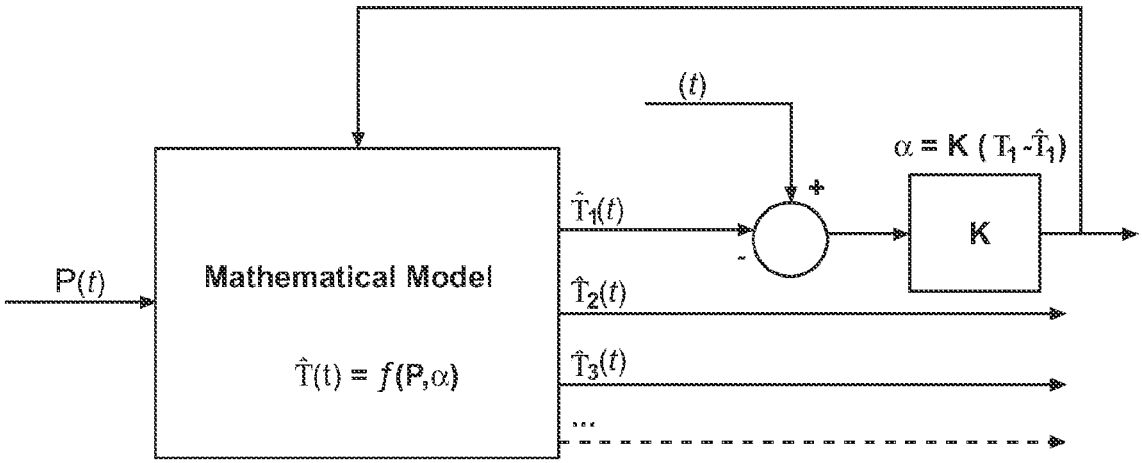
FIG. 2 is a sketch showing how the model according the invention works

With reference to FIG. 2, an estimation of the Power P(t) absorbed by the device is available (i.e. the power is measured, the power is assumed equal to a reference, the power is estimated on the basis of one or more electrical measurements).

Figure 1:
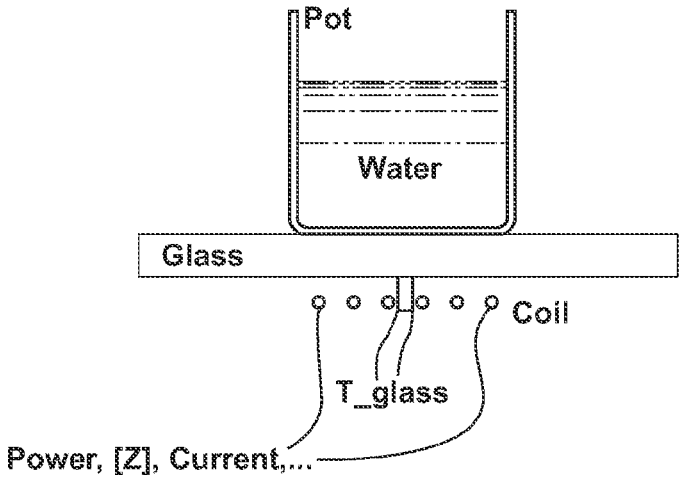
FIG. 1 is a schematic view of an induction cooktop

One (or more) temperature measurement $T_1(t)$ is carried out. Such temperature may be the temperature of the glass ceramic surface (as indicated by reference T_glass in FIG. 1), or the temperature of the induction coil or any other temperature of an element of the induction heating system.

A mathematical model, based on an overall thermal balance of the system, provides at least an estimation of the temperature (or temperatures) $\hat{T}_1(t), \hat{T}_2(t), \hat{T}_3(t), \ldots$ of the same element for which temperature has been measured by using the power estimation; the model can also provide estimation of other state variable (enthalpy, entropy, internal energy, etc.)

Any kind of algorithm that tunes on-line the mathematical model in function of the difference between estimated and measured temperature can be used according to the present invention.

The on-line tuning of the model represents a way to compensate the initial state uncertainty—i.e. if the model is based on differential equations, the initial state of the solution is required but it could be unknown; measurement errors (measurement are usually affected by noises); model uncertainties (i.e. each model is a simplified representation of the reality and so it is always affected by "model uncertainties").

The ability to compensate this kind of uncertainties and errors comes from a model based approach that combines the model and the tuning thereof by a feedback on the difference between prediction and measures. Many algorithms are available in literature to fix these kinds of problems (Recursive Least Square, Kalman Filter, Extended Kalman Filter [EKF] etc.).

Figure 3:
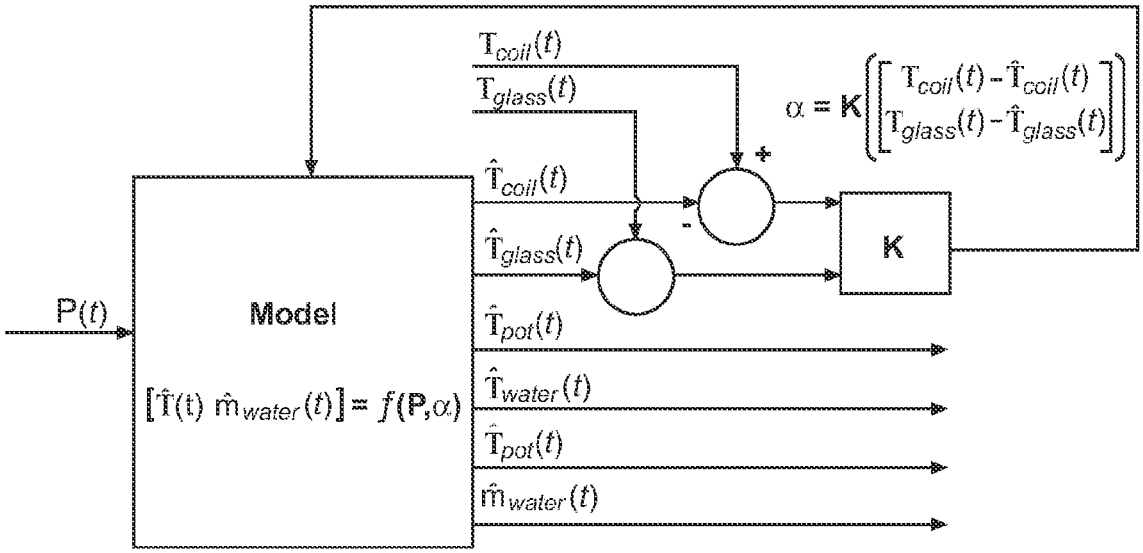
FIG. 3 is a schematical view of one possible implementation of the method according to the invention FIG. 4 show two diagrams comparing the actual relevant temperatures (pot and water) and their estimation according to the invention.

By following the above general approach, a possible example of implementation of the method in case the pot content is water is shown in FIG. 3, according to which the method is as well able to provide the water mass estimation. In this specific example the proposed method works as follows.

The power absorbed at the coil $\hat{P}(t)$ by the user requirement is estimated (we assume $\hat{P}(t)$=const.); the temperature of the glass and the coil $T_{glass}(t)$, $T_{coil}(t)$ are measured; the simplified mathematical model described by the following differential equations is used; in order to complete the method proposed in this example, the EKF method is used as on-line tuning algorithm.

The equations of the model proposed for this example are as follows:

$$C_{COIL}\dot{T}_{COIL} = (1-k_1)\hat{P} - (h_{CA}+h_{GC})T_{COIL} + h_{GC}T_{GLASS} + h_{CA}T_{AIR}$$

$$C_{GLAS}\dot{T}_{GLASS} = -\begin{pmatrix} h_{GA}+h_{GC}+ \\ h_{PG} \end{pmatrix} T_{GLASS} + h_{PG}T_{POT} + h_{GC}T_{COIL} + h_{GA}T_{AIR}$$

$$C_{POT}\dot{T}_{POT} = k_1\hat{P} - \begin{pmatrix} h_{PA}+ \\ h_{PG}+ \\ h_{PW} \end{pmatrix} T_{POT} + h_{PW}T_{water} + h_{PG}T_{GLASS} + h_{PA}T_{AIR}$$

$$m_{water}c_W\dot{T}_{water} = -\begin{pmatrix} h_{WA}+ \\ h_{PW} \end{pmatrix} T_{water} + h_{PW}T_{POT} + h_{WA}T_{AIR} + \dot{m}_{water}H_{vs}(P_{est})$$

$$\dot{m}_{water} = -\frac{P_{evap}}{\lambda(P_{est})} - \sigma\left(k\begin{pmatrix} T_{water} - \\ T_{SAT}(P_{est}) + \\ T_{sigma} \end{pmatrix}\right)\begin{bmatrix} -(h_{WA}+h_{PW})T_{water} + \\ h_{PW}T_{POT} + h_{WA}T_{AIR} - \\ \frac{P_{evap}}{\lambda(P_{est})}H_{vs} \end{bmatrix} \Big/ H_{vs}$$

$$P_{evap} = \phi(P_{TV}(T_W) - \eta)$$

$$\phi = const;\ \eta = const;\ T_0 = const;\ T_{sigma} = const;\ T_{AIR} = const;\ k_1 = const$$

where:

$C_{COIL}$→Equivalent thermal capacity of the Coil;
$C_{GLASS}$→Equivalent thermal capacity of the Glass;
$C_{POT}$→Equivalent thermal capacity of the Pot;
$c_W$→water specific thermal capacity;
$T_{COIL}$→Coil temperature;
$T_{GLASS}$→Glass temperature;
$T_{POT}$→Pot temperature;
$T_{water}$→Water temperature;
$m_{water}$→water mass;
P→Total active power absorbed at the coil;
$h_{CA}$→heat transfer coefficient coil to air multiplied by the relative surface;
$h_{GA}$→heat transfer coefficient glass to air multiplied by the relative surface;
$h_{PA}$→heat transfer coefficient pot to air multiplied by the relative surface;
$h_{WA}$→heat transfer coefficient water to air multiplied by the relative surface;
$h_{GC}$→heat transfer coefficient glass to coil multiplied by the relative surface;
$h_{PG}$→heat transfer coefficient pot to glass multiplied by the relative surface;
$h_{PW}$→heat transfer coefficient pot to water multiplied by the relative surface;
$P_{TV}(T_W)$→surface tension at temperature $T_W$;
$\lambda(P_{est})$→water evaporation latent heat at the pressure $P_{est}$
$H_{vs}(P_{est})$→saturated vapor enthalpy at the pressure $P_{est}$;
σ(k)→sigmoid function.

This example of model provides an estimation of different temperatures of interest (in this case $T_{coil}(t)$, $T_{glass}(t)$, $T_{pot}(t)$, $T_{water}(t)$), at least one of which must be measurable ($T_{coil}(t)$, $T_{glass}(t)$), the estimation of the water mass ($\hat{m}_{water}(t)$) and uses the estimated power absorbed at the coil ($\hat{P}(t)$). The same results can be achieved by using just another temperature measured in other places.

Hence, according to the above example, the general sketch of FIG. 2 is modified as in FIG. 3, where the element "K" represents the Kalman Matrix.

For the experimental set-up the applicant has chosen:

1 [kg] of water at 21 [°]→$T_{water}(t=0)$=21[°]

Pot at 21 [°]→$T_{POT}(t=0)$=21[°]

The initial conditions used by the applicant (in the model) to test the method are as follows:

$$\hat{T}_{COIL}(t=0) = T_{COIL}(t=0) = 27[\circ]$$
$$\hat{T}_{GLASS}(t=0) = T_{GLASS}(t=0) = 29[\circ]$$
$$\hat{T}_{POT}(t=0) = 33[\circ]$$
$$\hat{T}_{water}(t=0)31[\circ]$$
$$\hat{m}_{water}(t=0) = 0.8[\text{kg}]$$

In the above initial conditions the applicant has split up in 2 parts:

the first one is composed by measured information ($T_{coil}(t)$, $T_{glass}(t)$) at each time, so also at the beginning;

the second one, instead, is composed by unavailable information: some assumptions must be done introducing, as we already said, some kind of uncertainties. In the following it will be clear that the method is able to compensate this lack of information.

Figure 4:
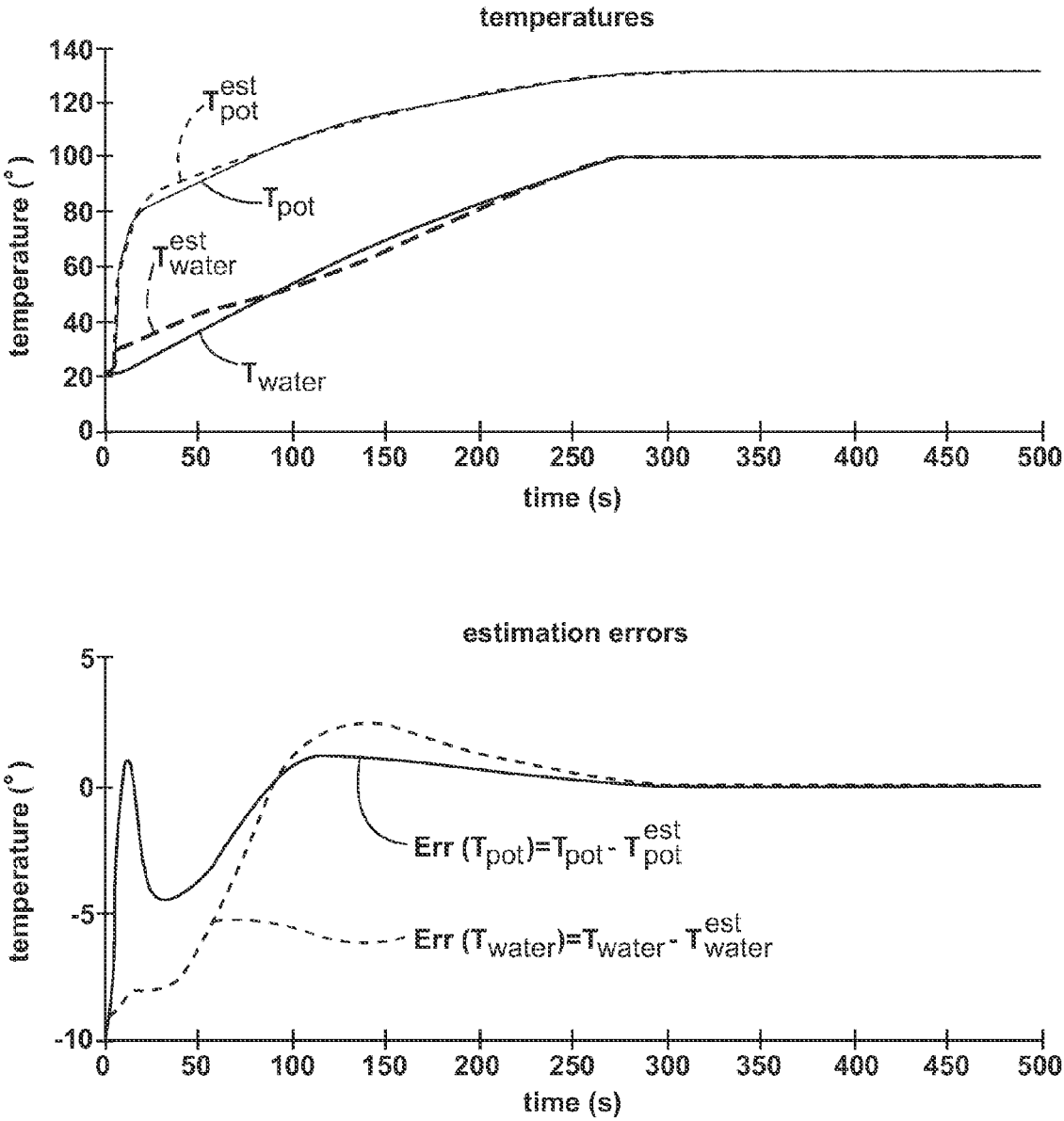
Figure 5:
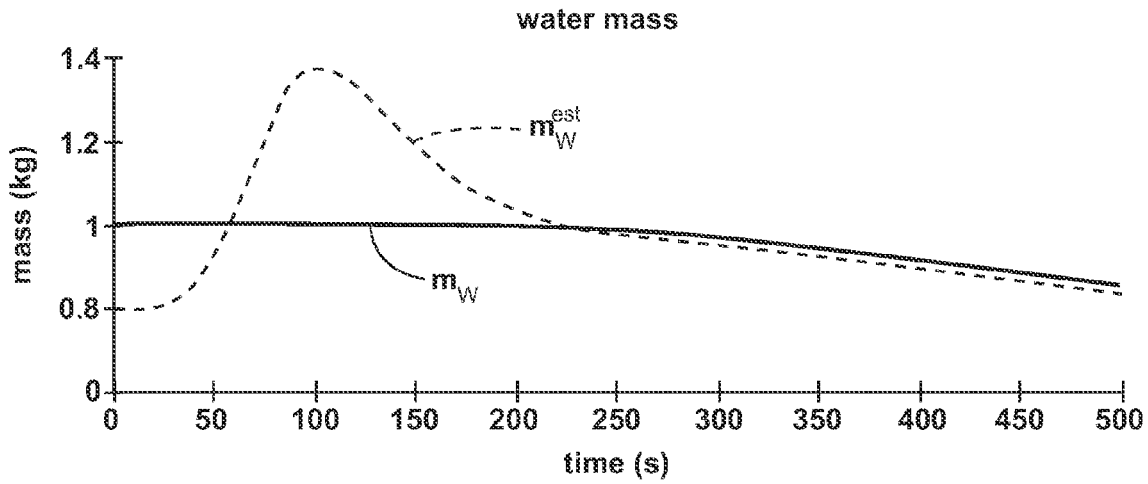
FIG. 5 is a figure similar to FIG. 4 and relates to a comparison between actual water mass and the estimation thereof according to the method of the invention.
Figure 5:
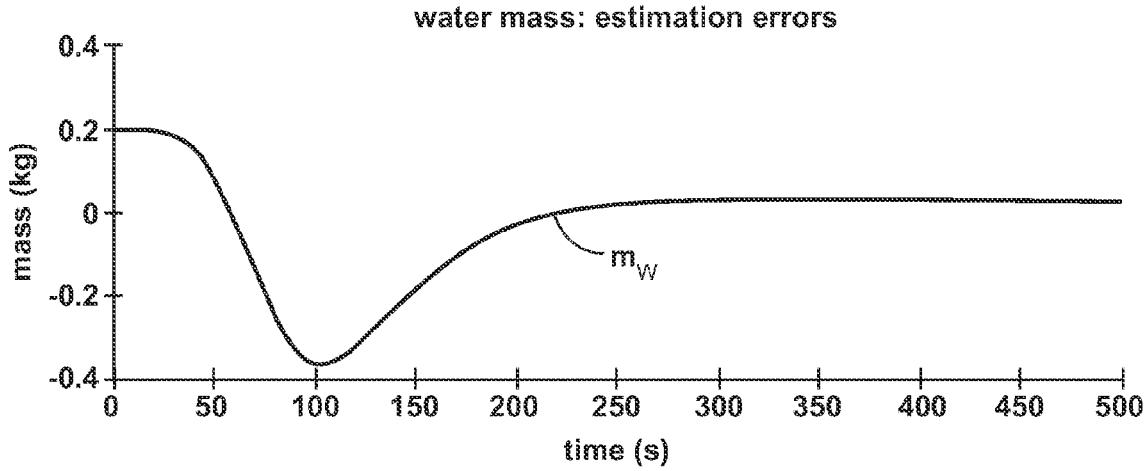
Figure 6:
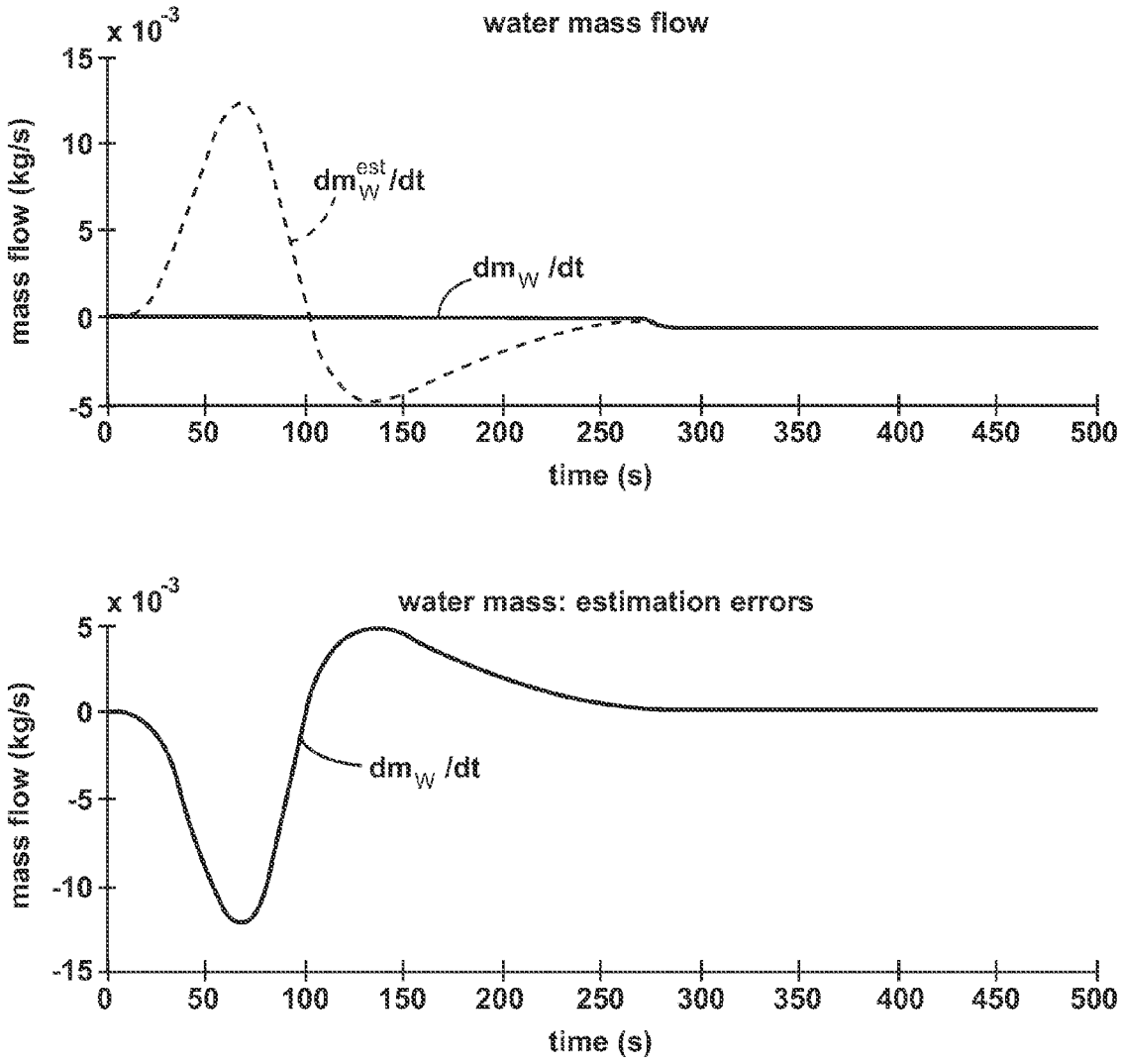
FIG. 6 is a figure similar to FIGS. 4 and 5 and relates to a comparison between the actual mass flow and the estimation thereof.

The values have been chosen with the aim to show the capability of the proposed method to compensate the difference between the initial conditions and the actual temperature and water mass of the system at the beginning of the process. Results of the algorithm are showed in FIGS. 4 to 6.

The present invention can be used to improve the performances of an induction cooktop, to provide more information about the status of the cooking phase and to enable new product features. In particular the main benefits are:

the estimated pot temperature can be used e.g. to monitor or control the the temperature;

by knowing the type of food, the computing model is able to detect a predetermined optimal working condition, for instance the optimal temperature for the Maillard reaction (if the food is meat or the like);

the estimated food temperature can be used e.g. to monitor or control the temperature or the cooking phase (as boil detection or boil control in case the 'food' is 'water' or similar kind of liquids);

the estimated food mass can be used e.g. to monitor or control the cooking phase;

the estimated coil temperature can be used e.g. to prevent damages to the induction coil.

Even if the control method according to the present invention is primarily for applications on cooktops or the like, it can be used also in induction ovens as well.

The invention claimed is:

1. A method for controlling an inductive heating system of a cooktop, provided with an induction coil, predetermined working condition, comprising:

assessing a value of power absorbed by the system to generate an assessed power value, measuring at least one temperature indicative of a thermal status of at least one element of the heating system to generate a measured temperature, feeding the assessed power value to a computing model to provide an estimated value of temperature;

comparing the measured temperature with the estimated value of temperature; and tuning the computing model based on such comparison.

2. The method according to claim 1, further comprising determining a type of food placed on the cooktop, and using the computing model to detect the predetermined working condition based on the type of food.

3. The method according to claim 1, wherein assessing the value of power absorbed by the system constitutes measuring the power.

4. The method according to claim 1, further comprising setting the value of the power absorbed by the system equal to a predetermined reference value.

5. The method according to claim 1, further comprising estimating the value of the power absorbed by the system based on one or more measures of electrical parameters of the system.

6. The method according to claim 1, further comprising compensating for at least one of the following: initial uncertainties on temperatures and mass, variations between cooking utensils, movement of a cooking utensil, electrical noises or combinations thereof.

7. The method according to claim 1, further comprising using the computing model to estimate another parameter of the computing model different from temperature.

8. The method according to claim 1, further comprising using one or more electrical measured values to improve controlling performance.

9. The method according to claim 1, wherein the computing model uses the following equations:

$$C_{COIL}\dot{T}_{COIL} = (1-k_1)\hat{P} - (h_{CA}+h_{GC})T_{COIL} + h_{GC}T_{GLASS} + h_{CA}T_{AIR}$$

$$C_{GLASS}\dot{T}_{GLASS} = -\begin{pmatrix} h_{GA}+ \\ h_{GC}+ \\ h_{PG} \end{pmatrix} T_{GLASS} + h_{PG}T_{POT} + h_{GC}T_{COIL} + h_{GA}T_{AIR}$$

$$C_{POT}\dot{T}_{POT} = k_1\hat{P} - \begin{pmatrix} h_{PA}+ \\ h_{PG}+ \\ h_{PW} \end{pmatrix} T_{POT} + h_{PW}T_{water} + h_{PG}T_{GLASS} + h_{PA}T_{AIR}$$

$$m_{water}c_W\dot{T}_{water} = -\begin{pmatrix} h_{WA}+ \\ h_{PW} \end{pmatrix} T_{water} + h_{PW}T_{POT} + h_{WA}T_{AIR} + \dot{m}_{water}H_{vs}(P_{est})$$

$$\dot{m}_{water} = -\frac{P_{evap}}{\lambda(P_{est})} - \sigma\left(k\begin{pmatrix} T_{water} - \\ T_{SAT}(P_{est}) + \\ T_{sigma} \end{pmatrix}\right)\left[\begin{matrix} -(h_{WA}+h_{PW})T_{water} + \\ h_{PW}T_{POT} + h_{WA}T_{AIR} - \\ \frac{P_{evap}}{\lambda(P_{est})}H_{vs} \end{matrix}\right] \Big/ H_{vs}$$

$$P_{evap} = \phi(P_{TV}(T_W) - \eta)$$

$$\phi = const;\ \eta = const;\ T_0 = const;$$

$$T_{sigma} = const;\ T_{AIR} = const;\ k_1 = const$$

where:

$C_{COIL}$→Equivalent thermal capacity of the Coil;

$C_{GLASS}$→Equivalent thermal capacity of the Glass;

$C_{POT}$→Equivalent thermal capacity of the Pot;

$c_W$→water specific thermal capacity;

$T_{COIL}$→Coil temperature;

$T_{GLASS}$→Glass temperature;

$T_{POT}$→Pot temperature;

$T_{water}$→Water temperature;

$m_{water}$→water mass;

P→Total active power absorbed at the coil;

$h_{CA}$→heat transfer coefficient coil to air multiplied by the relative surface;

$h_{GA}$→heat transfer coefficient glass to air multiplied by the relative surface;

$h_{PA}$→heat transfer coefficient pot to air multiplied by the relative surface;

$h_{WA}$→heat transfer coefficient water to air multiplied by the relative surface;

$h_{GC}$→heat transfer coefficient glass to coil multiplied by the relative surface;

$h_{PG}$→heat transfer coefficient pot to glass multiplied by the relative surface;

$h_{PW}$→heat transfer coefficient pot to water multiplied by the relative surface;

$P_{TV}(T_W)$→surface tension at temperature $T_W$;

$\lambda(P_{est})$→water evaporation latent heat at the pressure $P_{est}$ $H_{vs}(P_{est})$→saturated vapor enthalpy at the pressure $P_{est}$;

$\sigma(k)$→sigmoid function.

10. The method according to claim 1, further comprising using the computing model to provide the estimated value of temperature of a cooking utensil placed on the cooktop or of food contained therein.

11. The method according to claim 10, in which the food is water or similar liquid, wherein the predetermined working condition is a boiling condition.

12. A cooking appliance comprising an induction heating system with an induction coil and a control circuit, characterized in that the control circuit is adapted to measure at least one temperature indicative of a thermal status of at least one element of the heating system and comprises a computing model adapted to be fed with an assessed value of power adsorbed by the system, such computing model being adapted to provide an estimated value of temperature based on the assessed value of power absorbed and to compare such the estimated value of temperature to the measured temperature in order to tune the computing model based on such comparison.

13. A cooking appliance comprising:

an induction heating system with an induction coil; and a control circuit adapted to measure at least one temperature indicative of a thermal status of the induction heating system, said control circuit including a computing model adapted to be fed with an assessed value of power adsorbed by the system, said computing model being adapted to provide an estimated value of temperature based on the assessed value of power absorbed and to compare the estimated value of temperature to the measured temperature in order to tune the computing model based on such comparison.

14. The appliance according to claim 13, wherein the assessed value of power absorbed by the system is measured.

15. The appliance according to claim 13, wherein the assessed value of power absorbed by the system is set equal to a predetermined reference value.

16. The appliance according to claim 13, wherein the assessed value of the power absorbed by the system is estimated based on one or more measures of electrical parameters of the system.

17. The appliance according to claim 13, wherein the computing model compensates at least one of the following: initial uncertainties on temperatures and mass, variations between cooking utensils, movement of a cooking utensil, electrical noises or combinations thereof.

18. The appliance according to claim 13, wherein the computing model uses one or more electrical measured values to improve controlling performance.

19. The appliance according to claim 13, wherein the cooking appliance includes a cooktop and the computing model is capable of providing the estimated value of temperature of a cooking utensil placed on the cooktop or of food contained therein.

20. The appliance according to claim 19, in which the food is water or similar liquid.

* * * * *